US005905009A

United States Patent [19]

Nakamura et al.

[11] Patent Number: 5,905,009

[45] Date of Patent: May 18, 1999

[54] CHARGE GENERATION AGENT ELECTROPHOTOGRAPHIC PHOTOCONDUCTORS AND METHOD FOR MAKING SAME

[75] Inventors: Yoichi Nakamura; Kazumi Egota; Toshio Tsubota; Makoto Miyazawa, all of Nagano, Japan

[73] Assignee: Fuji Electric Co., Ltd., Japan

[21] Appl. No.: 08/947,214

[22] Filed: Oct. 8, 1997

[30] Foreign Application Priority Data

Oct. 9, 1996 [JP] Japan ..... 8-268205

[51] Int. Cl.[6] ..... G03G 5/047

[52] U.S. Cl. ..... 430/58; 430/78

[58] Field of Search ..... 430/78, 39, 58, 430/83

[56] References Cited

U.S. PATENT DOCUMENTS 5,736,282 4/1998 Tamura et al. ..... 430/78
5,750,300 5/1998 Nguyen ..... 430/78

FOREIGN PATENT DOCUMENTS 6289628 10/1994 Japan ..... G03G 5/00

*Primary Examiner*—John Goodrow
*Attorney, Agent, or Firm*—Morrison Law Firm

[57] ABSTRACT

A charge generation material for an electrophotographic photoconductor includes a titanyloxyphthalocyanine molecular aggregate. The titanyloxyphthalocyanine molecular aggregate contains between 0.006 to 1.000 water molecules per titanyloxyphthalocyanine molecule. The titanyloxyphthalocyanine molecular aggregate exhibits an X-ray diffraction spectrum, measured using CuKα radiation, having clear peaks at angles of 7.2°, 9.6°, 11.6°, 13.4°, 14.9°, 18.3°, 23.6°, 24.1° and 27.3°, the peak at 9.6° being the highest, the spectrum lacking a peak at 26.3°, and the angles being 2 θ±0.2°, where θ is a diffraction angle. A function-separation-type electrophotographic photoconductor includes the titanyloxyphthalocyanine molecular aggregate of the present invention in the charge generation layer. A monolayer-type electrophotographic photoconductor includes the titanyloxyphthalocyanine molecular aggregate of the present invention in the photoconductive layer.

18 Claims, 1 Drawing Sheet

CHARGE GENERATION AGENT ELECTROPHOTOGRAPHIC PHOTOCONDUCTORS AND METHOD FOR MAKING SAME

BACKGROUND OF THE INVENTION

The present invention relates to an electrophotographic photoconductor used in electrophotographic apparatuses, such as printers and copying machines. More specifically, the present invention relates to a charge generation material for the electrophotographic photoconductor and a method of manufacturing a electrophotographic photoconductor which includes the charge generation material.

Referring now to FIG. 1(*a*), a conventional function-separation-type electrophotographic photoconductor includes a conductive substrate 1, an undercoating layer 2, and a photoconductive layer 5. Photoconductive layer 5 contains a charge generation material that generates charges in response to exposure light. In a conventional function-separation-type electrophotographic photoconductor, photoconductive layer 5 includes a charge generation layer 3 for generating charges and a separate charge transport layer 4 for transporting the charges. Referring now to FIG. 1(*b*), a conventional monolayer-type electrophotographic photoconductor includes conductive substrate 1, undercoating layer 2, and photoconductive layer 5 which embodies charge generation and charge transport functions. Undercoating layer 2 is not a required element of either type of conventional photoconductor.

Metal phthalocyanines which contain a tetravalent metal ion to which an oxygen ion is bonded have been investigated intensively for the use as a charge generation material in electrophotographic photoconductors. Such metal phthalocyanines are also known to be stable in water. Titanyloxyphthalocyanine is an example of the above-described metal phthalocyanines.

The structural formula of titanyloxyphthalocyanine is shown in FIG. 2. A method of chemical synthesis of titanyloxyphthalocyanine is described by F. H. Moser, et. al. in "The Phthalocyanines", CRC Press (1983), the entirety of which is herein incorporated by reference. Photoconductive materials and electrophotographic photoconductors which employ titanyloxyphthalocyanine, and manufacturing methods for these are disclosed in the following publications: Japanese Unexamined Laid Open Patent Applications S59-49544, S59-166959, S59-204045, S61-109056, S61-171771, S62-61054, S62-67094, S63-116158, S63-218768, S64-17066, H01-120564, H01-138562, H01-299874, H02-8256, H02-28265, H05-320167, H06-289628, and U.S. Pat. No. 4,664,997.

Japanese Unexamined Laid Open Patent Application No. H06-289628 discloses the manufacture of an electrophotographic photoconductor which employs titanyloxyphthalocyanine as a charge generation material. The method of manufacture of the photoconductor employs a dispersion liquid, prepared by dispersing titanyloxyphthalocyanine in a dispersion medium which contains water at an amount (by weight) equal to or greater than the amount of the titanyloxyphthalocyanine. Although Japanese Unexamined Laid Open Patent Application No. H06-289628 discloses that the crystal form of titanyloxyphthalocyanine is maintained by adding water to the dispersion medium in the dispersion process, no description of the water contained in the titanyloxyphthalocyanine crystal or the titanyloxyphthalocyanine molecular aggregate is found.

Many proposals have been presented regarding photoconductive materials containing titanyloxyphthalocyanine.

However, the relationship between the titanyloxyphthalocyanine molecular aggregate and water in the manufacturing processes for electrophotographic photoconductors that use photoconductive material containing titanyloxyphthalocyanine has not been clarified. As a result, satisfactory electrophotographic properties have not been obtained in conventional photoconductors that contain titanyloxyphthalocyanine. In addition, coating liquids that contain titanyloxyphthalocyanine have unsatisfactorily short pot lives.

OBJECTS AND SUMMARY OF THE INVENTION

In view of the foregoing, it is an object of the invention to provide a stable coating liquid for a photoconductive layer that contains titanyloxyphthalocyanine molecular aggregates.

It is another object of the invention to provide a charge generation material that contains titanyloxyphthalocyanine molecular aggregates.

It is still another object of the invention to provide a photoconductor which includes titanyloxyphthalocyanine as a charge generation material, and which also exhibits excellent electrophotographic properties.

It is a further object of the invention to provide a method of manufacturing the electrophotographic photoconductor which includes titanyloxyphthalocyanine as a charge generation material.

Briefly stated, a charge generation material for an electrophotographic photoconductor includes a titanyloxyphthalocyanine molecular aggregate. The titanyloxyphthalocyanine molecular aggregate contains between 0.006 to 1.000 water molecules per titanyloxyphthalocyanine molecule. The titanyloxyphthalocyanine molecular aggregate exhibits an X-ray diffraction spectrum, measured using CuKα radiation, having clear peaks at angles of 7.2°, 9.6°, 11.6°, 13.4°, 14.9°, 18.3°, 23.6°, 24.1° and 27.3°, the peak at 9.6° being the highest, the spectrum lacking a peak at 26.3°, and the angles being 2 θ±0.2°, where θ is a diffraction angle. A function-separation-type electrophotographic photoconductor includes the titanyloxyphthalocyanine molecular aggregate of the present invention in the charge generation layer. A monolayer-type electrophotographic photoconductor includes the titanyloxyphthalocyanine molecular aggregate of the present invention in the photoconductive layer.

According to an embodiment of the present invention, a charge generation material for an electrophotographic photoconductor comprises titanyloxyphthalocyanine molecular aggregates, said aggregates containing from 0.006 to 1.00 water molecules per titanyloxyphthalocyanine molecule.

According to another embodiment of the present invention, an electrophotographic photoconductor comprises a conductive substrate, a charge generation layer, and a charge transport layer, said charge generation layer including titanyloxyphthalocyanine molecular aggregates, said aggregates containing from 0.006 to 1.00 water molecules per titanyloxyphthalocyanine molecule.

According to another embodiment of the present invention, an electrophotographic photoconductor comprises a conductive substrate, and a photoconductive layer on said substrate, said photoconductive layer including titanyloxyphthalocyanine molecular aggregates, said aggregates containing from 0.006 to 1.00 water molecules per titanyloxyphthalocyanine molecule.

According to another embodiment of the present invention, a method of manufacturing an electrophotographic photoconductor comprises the step of forming a photoconductive layer on a conductive substrate, said photoconductive layer including titanyloxyphthalocyanine molecular aggregates, said aggregates containing from 0.006 to 1.00 water molecules per titanyloxyphthalocyanine molecule.

According to another embodiment of the present invention, a method of manufacturing an electrophotographic photoconductor comprises the steps of forming a charge generation layer on a conductive substrate, said charge generation layer including titanyloxyphthalocyanine molecular aggregates, said aggregates containing from 0.006 to 1.00 water molecules per titanyloxyphthalocyanine molecule, and forming a charge transport layer on said charge generation layer.

According to another embodiment of the present invention, a method of manufacturing an electrophotographic photoconductor comprises the steps of forming a charge transport layer on a conductive substrate and forming a charge generation layer on said charge transport layer, said charge generation layer including titanyloxyphthalocyanine molecular aggregates, said aggregates containing from 0.006 to 1.00 water molecules per titanyloxyphthalocyanine molecule.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1(*b*) is a cross-sectional view of a typical monolayer-type electrophotographic photoconductor.

DETAILED DESCRIPTION OF THE PREFERRED EMBODIMENT

Figure 1A:
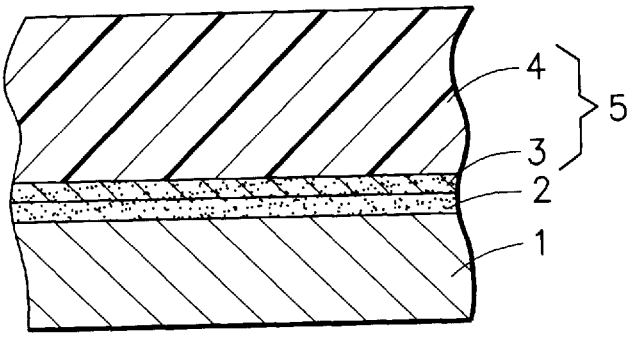
FIG. 1(*a*) is a cross-sectional view of a typical function-separation-type electrophotographic photoconductor.
Figure 1B:
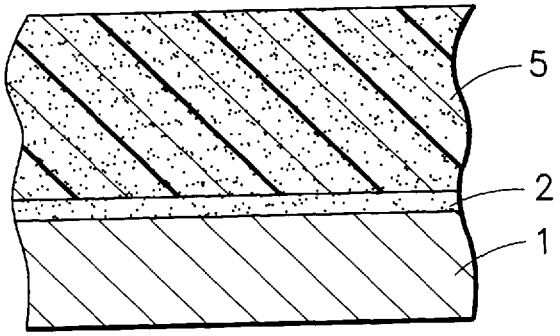
Figure 2:
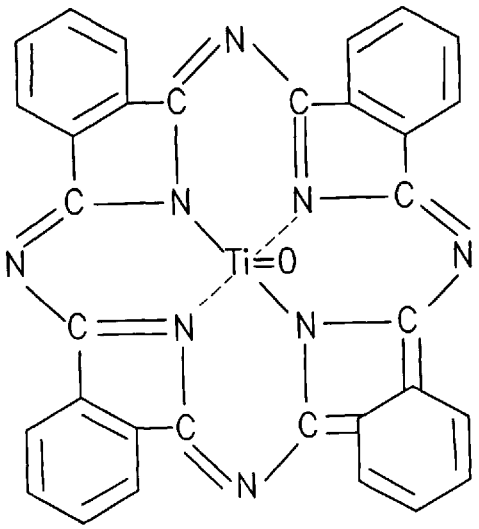
FIG. 2 is the structural formula of titanyloxyphthalocyanine.

A function-separation-type electrophotographic photoconductor, as shown in FIG. 1(*a*), or a monolayer-type electrophotographic photoconductor, as shown in FIG. 1 (*b*), may be manufactured including the charge generation material of the present invention.

Metals, conductive plastics or insulator plates provided with a conductive surface may be used for the conductive substrate.

The charge generation layer of the present invention is formed by preparing a coating liquid containing titanyloxyphthalocyanine molecular aggregates. The coating liquid contains a binder solution which includes a binder resin and into which the charge generation material is dispersed. Any appropriate binder resin may be employed. Preferably, poly (vinyl chloride) resin, ketal resin, vinyl acetate resin and acrylic resin may be used for the binder. Any appropriate organic solvent, such as dichloromethane, dichloroethane or tetrahydrofuran, may be used for the binder solvent. Dip-coating, spray-coating and other coating methods which do not change the structure of the titanyloxyphthalocyanine molecular aggregate may be used in applying the coating liquid.

First Embodiment

In a reactor, 800 g of o-phthalodinitrile and 1.81 of quinoline were stirred. Then, 297 g of titanium tetrachloride was added dropwise to the foregoing mixture with stirring under a nitrogen atmosphere. Next, the reactant solution was heated at 180 ° C. and stirred for 15 hr.

The reactant solution was cooled to 130° C., and then filtered. The residual cake was washed with 2 l of N-methyl-2-pyrrolidinone and then with 4 l of warm water.

The thus obtained wet cake was heated at 80° C. for one hour in a dilute hydrochloric acid solution (360 ml of 36% hydrochloric acid in 4 l of water), cooled, filtered, washed with 4 l of warm water, and dried.

200 g of the thus prepared titanyloxyphthalocyanine was added to 4 kg of 96% sulfuric acid with cooling and stirring. The temperature of the solution was maintained at −5° C. while cooling and stirring. The sulfuric acid solution was then further stirred for an hour. Next, the sulfuric acid solution was added to 35 l of water, to which 5 kg of ice was added, with cooling and stirring of the aqueous solution so that the solution temperature did not exceed 10° C. The solution was cooled and stirred for an hour. A wet cake was obtained by filtering the solution and by washing the residual cake with 10 l of warm water.

The thus obtained wet cake was mixed with dilute hydrochloric acid containing 770 ml of 36% hydrochloric acid in 10 l of water. The mixture was heated at 80° C. and stirred for an hour. Then, the mixture was cooled and filtered. The residual cake was washed with 10 l of warm water. The water content of the cake was adjusted by exposing the residual cake to air and allowing natural evaporation to occur. The water content of the final cake, measured according to the JIS (Japanese Industrial Standards) K-0067 "Test method for loss and residue of chemical products", was 88%. The final wet cake was milled with 1.5 l of o-dichlorobenzene for 24 hr in a ball mill containing 6.6 kg of zirconia balls of 8 mm in diameter.

The milled cake was removed from the ball mill with 1.5 l of acetone and 1.5 l of methanol. Finally, titanyloxyphthalocyanine molecular aggregate was obtained by filtering the milled cake, washing the cake with 1.5 l of water and drying.

Second Embodiment

The titanyloxyphthalocyanine molecular aggregate was prepared in a similar manner as the first embodiment, except that the water content in the wet cake before milling was adjusted to be 5%.

Third Embodiment

The titanyloxyphthalocyanine molecular aggregate was prepared in a similar manner as the first embodiment, except that the water content in the wet cake before milling was adjusted to be 20%.

Fourth Embodiment

The titanyloxyphthalocyanine molecular aggregate was prepared in a similar manner as the first embodiment, except that the water content in the wet cake before milling was adjusted to be 93%.

Fifth Embodiment

The titanyloxyphthalocyanine molecular aggregate was prepared in a similar manner as the first embodiment, except that the water content in the wet cake before milling was adjusted to be 98%.

COMPARATIVE EXAMPLE 1

The titanyloxyphthalocyanine molecular aggregate was prepared in a similar manner as the first embodiment, except that the water content in the wet cake before milling was adjusted to be 0.1%.

COMPARATIVE EXAMPLE 2

The titanyloxyphthalocyanine molecular aggregate was prepared in a similar manner as the first embodiment, except that the water content in the wet cake before milling was adjusted to be 99%.

The number of water molecules per titanyloxyphthalocyanine molecule in the titanyloxyphthalocyanine molecular aggregates of the first through fifth Embodiments and the Comparative Examples 1 and 2 was calculated based on the water contents measured with a quantitative-titration-type Karl Fisher moisture meter ( Type MKA-3p, from Kyoto Electronic Industrial Inc.) according to the JIS K-0068 "Test methods for water content of chemical products".

The conversion equation is shown below $$Tw=(Ts\cdot Tw\cdot 10^{-6}/Wm)/(Ts\cdot(1-Wr\cdot 10^{-6})Tm) \quad (1)$$

where Tw equals the number of water molecules per titanyloxyphthalocyanine molecule in the titanyloxyphthalocyanine molecular aggregate; Ts is the sample weight (g) of the titanyloxyphthalocyanine molecular aggregate; Wr the water content (ppm) of the titanyloxyphthalocyanine molecular aggregate; Tm the molecular weight of titanyloxyphthalocyanine; and Wm the molecular weight of water.

Table 1 lists the number of water molecules per titanyloxyphthalocyanine molecule in the titanyloxyphthalocyanine molecular aggregates of the Embodiments and the Comparative Examples.

TABLE 1

| | Number of water molecules |
|---|---|
| Embodiment 1 | 0.025 |
| Embodiment 2 | 0.006 |
| Embodiment 3 | 0.010 |
| Embodiment 4 | 0.34 |
| Embodiment 5 | 1.0 |
| Comparative Example 1 | 0.003 |
| Comparative Example 2 | 2.1 |

As Table indicates, the number of water molecules per titanyloxyphthalocyanine molecule in the Embodiments is between 0.006 and 1.0. The number of water molecules per titanyloxyphthalocyanine molecule in each of the Comparative Examples is outside this range.

The X-ray diffraction spectra of the titanyloxyphthalocyanine molecular aggregates were measured by an X-ray diffractometer ( from Mac Science Inc.) using CuKα radiation. The titanyloxyphthalocyanine molecular aggregates of the Embodiments exhibited clear peaks at the angles (2 θ±0.2°) of 7.2°, 9.6°, 11.6°, 13.4°, 14.9°, 18.3°, 23.6°, 24.1° and 27.3°. The peak at 9.6° was the highest. The titanyloxyphthalocyanine molecular aggregates of the Embodiments did not exhibit a clear peak at 26.3°. In the X-ray diffraction spectra of the Comparative Examples, the peak at 27.3° was remarkably reduced, and a clear peak was observed at 26.3°.

Sixth Embodiment

The photoconductor of the sixth embodiment was fabricated as described below by laminating an undercoating layer onto a conductive substrate, a charge generation layer onto the undercoating layer, and a charge transport layer onto the charge generation layer.

The coating liquid for the undercoating layer was prepared by mixing 70 weight parts of polyamide resin (Amilan CM 8000, from TORAY INDUSTRIES, INC.) and 930 weight parts of methanol (from Wako Pure Chemical Industries, Ltd.). The coating liquid was coated onto an aluminum substrate by dip-coating and dried. The undercoating layer was formed to be 0.5 μm in thickness after drying.

Ten weight parts of the titanyloxyphthalocyanine molecular aggregate of the First Embodiment, 10 weight parts of vinyl chloride resin (MR-110, from Nippon Zeon Co., Ltd.), 686 weight parts of dichloromethane (from Wako Pure Chemical Industries, Ltd.) and 294 weight parts of 1-2 dichloromethane (from Wako Pure Chemical Industries, Ltd.) were mixed. The mixture was further dispersed by ultrasonic dispersion, producing the undercoating liquid for the charge generation layer. The coating liquid for the charge generation layer was coated on the undercoating layer by dip-coating and dried. The charge generation layer was formed to be 0.2 μm in thickness after drying.

The coating liquid for the charge transport layer was prepared by mixing 100 weight parts of 4-(diphenylamino) benzaldehyde phenyl(2-thienylmethyl)hydrazone (synthesized in Fuji Electric by the conventional method of organic synthesis), 100 weight parts of polycarbonate resin (Panlite K-1300, from TEIJIN CHEMICALS, LTD.), 800 weight parts of dichloromethane (from Wako Pure Chemical Industries, Ltd.) and 1 weight part of silane coupling agent (KP-340, from Shin-Etsu Chemical Co., Ltd.). The coating liquid for the charge transport layer was coated on the charge generation layer by dip-coating and dried. The charge transport layer was formed to be 20 μm in thickness after drying.

Seventh Embodiment

The photoconductor of the seventh embodiment was fabricated in a similar manner as the sixth embodiment, except that the titanyloxyphthalocyanine molecular aggregate of the second embodiment was used in the seventh embodiment.

Eighth Embodiment

The photoconductor of the eighth embodiment was fabricated in a similar manner as the sixth embodiment, except that the titanyloxyphthalocyanine molecular aggregate of the third embodiment was used in the eighth embodiment.

Ninth Embodiment

The photoconductor of the ninth embodiment was fabricated in a similar manner as the sixth embodiment, except that the titanyloxyphthalocyanine molecular aggregate of the fourth embodiment was used in the ninth embodiment.

Tenth Embodiment

The photoconductor of the tenth embodiment was fabricated in a similar manner as the sixth embodiment, except that the titanyloxyphthalocyanine molecular aggregate of the fifth embodiment was used in the eighth embodiment.

COMPARATIVE EXAMPLE 3

The photoconductor of the Comparative Example 3 was fabricated in a similar manner as the sixth embodiment, except that the titanyloxyphthalocyanine molecular aggregate of Comparative Example 1 was used in Comparative Example 3.

COMPARATIVE EXAMPLE 4

The photoconductor of Comparative Example 4 was fabricated in a similar manner as the sixth embodiment, except that the titanyloxyphthalocyanine molecular aggregate of Comparative Example 2 was used in Comparative Example 4.

The electrical properties of the thus fabricated photoconductors were measured in an electrostatic recording paper tester (EPA-8100, from Kawaguchi Electric Works Co., Ltd.).

The surfaces of the photoconductors were charged to be negative in the dark by corona discharge at −5 kV for 10 sec and then irradiated with a laser beam of 780 nm in wavelength. The exposure light intensities ($\mu J/cm^2$) necessary to reduce the surface potential from −600 V to −100 V were measured. Table 2 lists the measured exposure light intensities.

TABLE 2

| | Exposure Light Intensity ($\mu J/cm^2$) |
|---|---|
| Embodiment 6 | 0.084 |
| Embodiment 7 | 0.087 |
| Embodiment 8 | 0.084 |
| Embodiment 9 | 0.086 |
| Embodiment 10 | 0.085 |
| Comparative Example 3 | 0.110 |
| Comparative Example 4 | 0.102 |

As Table 2 indicates, the exposure light intensities of the Embodiments are low, indicating that the sensitivities of the Embodiments are high, and the intensity variations are small. On the other hand, the Comparative Examples have higher exposure light intensities and therefore lower sensitivities, which make the Comparative Examples impracticable.

Eleventh Embodiment

The photoconductor of the eleventh embodiment was fabricated in a similar manner as the sixth embodiment, except that the coating liquid for the charge generation layer of the first embodiment was circulated in the dip-coating apparatus for a month and then used for the eleventh embodiment.

Twelfth Embodiment

The photoconductor of the twelfth embodiment was fabricated in a similar manner as the seventh embodiment, except that the coating liquid for the charge generation layer of the second embodiment was circulated in the dip-coating apparatus for a month and then used for the twelfth embodiment.

Thirteenth Embodiment

The photoconductor of the thirteenth embodiment was fabricated in a similar manner as the eighth embodiment, except that the coating liquid for the charge generation layer of the third embodiment was circulated in the dip-coating apparatus for a month and then used for the thirteenth embodiment.

Fourteenth Embodiment

The photoconductor of the fourteenth embodiment was fabricated in a similar manner as the ninth embodiment, except that the coating liquid for the charge generation layer of the fourth embodiment was circulated in the dip-coating apparatus for a month and then used for the fourteenth embodiment.

Fifteenth Embodiment

The photoconductor of the fifteenth embodiment was fabricated in a similar manner as the tenth embodiment, except that the coating liquid for the charge generation layer of the fifth embodiment was circulated in the dip-coating apparatus for a month and then used for the fifteenth embodiment.

COMPARATIVE EXAMPLE 5

The photoconductor of Comparative Example 5 was fabricated in a similar manner as Comparative Example 3, except that the coating liquid for the charge generation layer of Comparative Example 1 was circulated in the dip-coating apparatus for a month and then used for Comparative Example 5.

COMPARATIVE EXAMPLE 6

The photoconductor of the Comparative Example 6 was fabricated in a similar manner as Comparative Example 4, except that the coating liquid for the charge generation layer of Comparative Example 2 was circulated in the dip-coating apparatus for a month and then used for Comparative Example 6.

The electrical properties of the thus fabricated photoconductors of the eleventh through fifteenth Embodiments and Comparative Examples 5 and 6 were measured in the same manner as the sixth through tenth Embodiments. Table 3 lists the measured exposure light intensities.

TABLE 3

| | Exposure Light Intensity ($\mu J/cm^2$) |
|---|---|
| Embodiment 11 | 0.084 |
| Embodiment 12 | 0.088 |
| Embodiment 13 | 0.085 |
| Embodiment 14 | 0.086 |
| Embodiment 15 | 0.085 |
| Comparative Example 5 | 0.327 |
| Comparative Example 6 | 0.294 |

By comparing Table 3 with Table 2, it is evident that the exposure light intensities of the eleventh through fifteenth embodiments are almost identical to those of the sixth through tenth embodiments. This indicates that the coating liquids for the charge generation layers of the sixth through tenth embodiments are very stable. On the other hand, the exposure light intensities of the Comparative Examples vary greatly with time, indicating the coating liquids for the charge generation layers of the Comparative Examples are disadvantageously unstable.

According to the invention, a titanyloxyphthalocyanine molecular aggregate that contains from 0.006 to 1.00 water molecule per titanyloxyphthalocyanine molecule is used as the charge generation material in an electrophotographic photoconductor. The titanyloxyphthalocyanine molecular aggregate exhibits an X-ray diffraction spectrum, measured with CuK$\alpha$ radiation, having clear peaks at angles of 7.2°, 9.6°, 11.6°, 13.4°, 14.9°, 18.3°, 23.6°, 24.1° and 27.3°, the peak at 9.6° being the highest, the spectrum lacking a peak at 26.3°, the angles being 2 $\theta \pm 0.2°$ and $\theta$ being a diffraction angle. In the water content range described above, the photoconductor is highly sensitive by virtue of the specific stable molecular configurations independent of the water contents, and the sensitivity distributes within a narrow range.

For the same reason, the coating liquid for the charge generation layer that includes the charge generation material of the invention is very stable over many days. Therefore, the photoconductors which include the charge generation layer containing the titanyloxyphthalocyanine molecular aggregates of the invention are very stable, irrespective of when the coating liquid for the charge generation layer is prepared. Since the long term stability of the present coating liquid for the charge generation layer facillitates adding newly prepared coating liquid to the previously prepared one, the efficiency of the coating process for the charge generation layer is improved.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A charge generation material for an electrophotographic photoconductor, comprising:

titanyloxyphthalocyanine molecular aggregates;

said aggregates containing from 0.006 to 1.00 water molecules per titanyloxyphthalocyanine molecule.

2. A charge generation material according to claim 1, wherein said titanyloxyphthalocyanine molecular aggregates exhibit an X-ray diffraction spectrum in response to irradiation with CuKα radiation;

said diffraction spectrum including peaks at angles of 7.2°, 9.6°, 11.6°, 13.4°, 14.9°, 18.3°, 23.6°, 24.1° and 27.3°;

said peak at 9.6° being the highest;

said spectrum lacking a peak at 26.3°; and said angles being 2 θ±0.2°, wherein θ is a diffraction angle.

3. An electrophotographic photoconductor, comprising:

a conductive substrate;

a charge generation layer; and a charge transport layer;

said charge generation layer including titanyloxyphthalocyanine molecular aggregates;

said aggregates containing from 0.006 to 1.00 water molecules per titanyloxyphthalocyanine molecule.

4. An electrophotographic photoconductor according to claim 3, wherein said titanyloxyphthalocyanine molecular aggregates exhibit an X-ray diffraction spectrum in response to irradiation with CuKα radiation;

said diffraction spectrum including peaks at angles of 7.2°, 9.6°, 11.6°, 13.4°, 14.9°, 18.3°, 23.6°, 24.1° and 27.3°;

said peak at 9.6° being the highest;

said spectrum lacking a peak at 26.3°; and said angles being 2 θ±0.2°, wherein θ is a diffraction angle.

5. An electrophotographic photoconductor, comprising:

a conductive substrate; and a photoconductive layer on said substrate;

said photoconductive layer including titanyloxyphthalocyanine molecular aggregates;

said aggregates containing from 0.006 to 1.00 water molecules per titanyloxyphthalocyanine molecule.

6. An electrophotographic photoconductor according to claim 5, wherein said titanyloxyphthalocyanine molecular aggregates exhibit an X-ray diffraction spectrum in response to irradiation with CuKα radiation;

said diffraction spectrum including peaks at angles of 7.2°, 9.6°, 11.6°, 13.4°, 14.9°, 18.3°, 23.6°, 24.1° and 27.3°;

said peak at 9.6° being the highest;

said spectrum lacking a peak at 26.3°; and said angles being 2 θ±0.2°, wherein θ is a diffraction angle.

7. A method of manufacturing an electrophotographic photoconductor, comprising the step of:

forming a photoconductive layer on a conductive substrate;

said photoconductive layer including titanyloxyphthalocyanine molecular aggregates;

said aggregates containing from 0.006 to 1.00 water molecules per titanyloxyphthalocyanine molecule.

8. A method of manufacturing an electrophotographic photoconductor, comprising the steps of:

forming a charge generation layer on a conductive substrate;

said charge generation layer including titanyloxyphthalocyanine molecular aggregates;

said aggregates containing from 0.006 to 1.00 water molecules per titanyloxyphthalocyanine molecule; and forming a charge transport layer on said charge generation layer.

9. A method of manufacturing an electrophotographic photoconductor, comprising the steps of:

forming a charge transport layer on a conductive substrate; and forming a charge generation layer on said charge transport layer;

said charge generation layer including titanyloxyphthalocyanine molecular aggregates;

said aggregates containing from 0.006 to 1.00 water molecules per titanyloxyphthalocyanine molecule.

10. A method of manufacturing an electrophotographic photoconductor according to claim 7, wherein:

said titanyloxyphthalocyanine molecular aggregates exhibit an X-ray diffraction spectrum in response to irradiation with CuKα radiation;

said diffraction spectrum including peaks at angles of 7.2°, 9.6°, 11.6°, 13.4°, 14.9°, 18.3°, 23.6°, 24.1° and 27.3°;

said peak at 9.6° being the highest;

said spectrum lacking a peak at 26.3°; and said angles being 2 θ±0.2°, wherein θ is a diffraction angle.

11. A method of manufacturing an electrophotographic photoconductor according to claim 8, wherein:

said titanyloxyphthalocyanine molecular aggregates exhibit an X-ray diffraction spectrum in response to irradiation with CuKα radiation;

said diffraction spectrum including peaks at angles of 7.2°, 9.6°, 11.6°, 13.4°, 14.9°, 18.3°, 23.6°, 24.1° and 27.3°;

said peak at 9.6° being the highest;

said spectrum lacking a peak at 26.3°; and said angles being 2 θ±0.2°, wherein θ is a diffraction angle.

12. A method of manufacturing an electrophotographic photoconductor according to claim 9, wherein:

said titanyloxyphthalocyanine molecular aggregates exhibit an X-ray diffraction spectrum in response to irradiation with CuKα radiation;

said diffraction spectrum including peaks at angles of 7.2°, 9.6°, 11.6°, 13.4°, 14.9°, 18.3°, 23.6°, 24.1° and 27.3°;

said peak at 9.6° being the highest;

said spectrum lacking a peak at 26.3°; and said angles being 2 θ±0.2°, wherein θ is a diffraction angle.

13. A method of manufacturing an electrophotographic photoconductor according to claim 7, wherein said step of forming a photoconductive layer includes preparing a coating liquid containing a binder, into which are dispersed titanyloxyphthalocyanine molecular aggregates;

said aggregates containing from 0.006 to 1.00 water molecules per titanyloxyphthalocyanine molecule;

coating said coating liquid onto said conductive substrate; and drying said coating liquid on said conductive substrate.

14. A method of manufacturing an electrophotographic photoconductor according to claim 8, wherein said step of forming a charge generation layer includes preparing a coating liquid containing a binder, into which are dispersed titanyloxyphthalocyanine molecular aggregates;

said aggregates containing from 0.006 to 1.00 water molecules per titanyloxyphthalocyanine molecule;

coating said coating liquid onto said conductive substrate; and drying said coating liquid on said conductive substrate.

15. A method of manufacturing an electrophotographic photoconductor according to claim 9, wherein said step of forming a charge generation layer includes preparing a coating liquid containing a binder, into which are dispersed titanyloxyphthalocyanine molecular aggregates;

said aggregates containing from 0.006 to 1.00 water molecules per titanyloxyphthalocyanine molecule;

coating said coating liquid onto said conductive substrate; and drying said coating liquid on said conductive substrate.

16. A method of manufacturing an electrophotographic photoconductor according to claim 13, wherein:

said titanyloxyphthalocyanine molecular aggregates exhibit an X-ray diffraction spectrum in response to irradiation with CuKα radiation;

said diffraction spectrum including peaks at angles of 7.2°, 9.6°, 11.6°, 13.4°, 14.9°, 18.3°, 23.6°, 24.1° and 27.3°;

said peak at 9.6° being the highest;

said spectrum lacking a peak at 26.3°; and said angles being 2 θ±0.2°, wherein θ is a diffraction angle.

17. A method of manufacturing an electrophotographic photoconductor according to claim 14, wherein:

said titanyloxyphthalocyanine molecular aggregates exhibit an X-ray diffraction spectrum in response to irradiation with CuKα radiation;

said diffraction spectrum including peaks at angles of 7.2°, 9.6°, 11.6°, 13.4°, 14.9°, 18.3°, 23.6°, 24.1° and 27.3°;

said peak at 9.6° being the highest;

said spectrum lacking a peak at 26.3°; and said angles being 2 θ±0.2°, wherein θ is a diffraction angle.

18. A method of manufacturing an electrophotographic photoconductor according to claim 15, wherein:

said titanyloxyphthalocyanine molecular aggregates exhibit an X-ray diffraction spectrum in response to irradiation with CuKα radiation;

said diffraction spectrum including peaks at angles of 7.2°, 9.6°, 11.6°, 13.4°, 14.9°, 18.3°, 23.6°, 24.1° and 27.3°;

said peak at 9.6° being the highest;

said spectrum lacking a peak at 26.3°; and said angles being 2 θ±0.2°, wherein θ is a diffraction angle.

* * * * *